US005417003A

United States Patent [19]

Claveau

[11] Patent Number: 5,417,003

[45] Date of Patent: * May 23, 1995

[54] TOOL FOR LOADING AND UNLOADING CARTRIDGES FROM A FIREARM MAGAZINE

[75] Inventor: Gerard A. Claveau, Hesperia, Calif.

[73] Assignee: Corinne C. Claveau, Hesperia, Calif.

[ * ] Notice: The portion of the term of this patent subsequent to Jul. 5, 2008 has been disclaimed.

[21] Appl. No.: 102,136

[22] Filed: Aug. 3, 1993

[51] Int. Cl.[6] ..... F41A 9/83

[52] U.S. Cl. ..... 42/90; 7/169; 42/87

[58] Field of Search ..... 42/87, 90; 7/169; 70/452; 220/241; D8/350, 353

[56] References Cited

U.S. PATENT DOCUMENTS

| | | | |
|---|---|---|---|
| D. 34,564 | 5/1901 | Glynn | D8/350 |
| 104,838 | 6/1870 | Drowne | 70/452 |
| D. 246,433 | 11/1977 | Tegner | D8/350 |
| 266,193 | 10/1882 | Parks | 7/169 |
| D. 348,503 | 7/1994 | Claveau | D22/108 |
| 3,939,590 | 2/1976 | Musgrave | 42/90 |
| 4,032,030 | 6/1977 | Bass et al. | 220/241 |
| 4,464,855 | 8/1984 | Musgrave | 42/87 |
| 4,719,715 | 1/1988 | Howard | 42/87 |
| 4,829,693 | 5/1989 | Holmes | 42/87 |
| 4,862,621 | 9/1989 | Kearney | 42/87 |
| 4,939,862 | 7/1990 | Brandenburg et al. | 42/88 |
| 4,993,180 | 2/1991 | Upchurch | 42/87 |
| 5,261,136 | 11/1993 | Hall | 42/90 |

FOREIGN PATENT DOCUMENTS

| | | | |
|---|---|---|---|
| 248833 | 3/1948 | Switzerland | 42/90 |

OTHER PUBLICATIONS

"Hunting Catalog 1993", Bass Pro Shops, p. 165, New HKS Magazine Speedloader.

"Hunting Catalog 1993", Bass Pro Shops, p. 171, Speed Loader.

*Primary Examiner*—Stephen C. Bentley

*Attorney, Agent, or Firm*—Price, Gess & Ubell

[57] ABSTRACT

A device for loading and unloading cartridges into a magazine used in semi-automatic firearms. More particularly, the improved device can universally unload, easily and quickly, all currently manufactured foreign and domestic firearm magazines. The device also universally loads all currently manufactured foreign and domestic pistol magazines.

14 Claims, 7 Drawing Sheets

TOOL FOR LOADING AND UNLOADING CARTRIDGES FROM A FIREARM MAGAZINE

BACKGROUND OF THE INVENTION

1. Field of the Invention

The present invention is within the field of tools for loading and unloading cartridges from a firearm magazine.

2. Description of the Related Art

Many small arms, including both rifles and handguns, utilize magazines for holding cartridges to assist in feeding the cartridges into the firearm. The detachable box magazine has become the dominant type of magazine used for automatic weapons throughout the world. The term box magazine is broad, encompassing several geometric variations, including curved box magazines. The variations are in form and structure, rather than in the general principles of operation.

In these firearms, ammunition (cartridges) is placed into a magazine which is an elongated container having a generally rectangular cross-section. The container, known as a magazine, is then fitted into a portion of the firearm proximate to the firing chamber. The magazine is closed on five sides and open on a sixth side, which is a rectangular shaped end. Such magazines are spring loaded and further adapted with retaining members over the open end. Cartridges are stacked in a linear fashion and are oriented in a manner such that the longitudinal axes of the cartridges are substantially parallel with one another. Many modern firearms employ detachable magazines which can be removed from the firearms for refilling when all of the cartridges have been expended.

In operation, a fully loaded magazine is fitted into a position adjacent to or against the firing chamber of the weapon. Normally a bolt is used to extract a spent round and force a new round into the firing chamber. As each round is fired, the bolt recoils backward, expelling the spent cartridge and pushing forward to pick up the next round. The force of the spring pushes each round up into a position adjacent to the retaining or feed lips of the magazine wherein the bolt can push it into the firing chamber.

In order to a achieve a higher capacity, many firearms utilize a "stacked" magazine in which the cartridges are held in two staggered rows, and the cartridges advance to the feed position, under spring pressure, as a group. Feeding takes place alternately from the left and the right feed lip of the magazine. The space between the lips is greater than the maximum diameter of a cartridge thus allowing convenient refilling of the magazine.

When a magazine is depleted (i.e. all the cartridges have been expended), then the magazine must be reloaded with cartridges. Ammunition is then slipped axially rearwardly into the open end of the magazine, piece by piece, with each cartridge slipping past the retaining lips to be held until used. As the magazine is being loaded, it is necessary to depress all previously loaded cartridges before additional cartridges can be loaded. As each succeeding round of ammunition in loaded, the spring is further compressed and it becomes harder to insert each seceding cartridge. Most magazines can be reloaded by hand without the use of any apparatus. However, hand reloading is often slow, tedious, and cumbersome so that it is useful to provide an apparatus for assisting in the reloading process. In cases where the cartridges are short it is particularly difficult to load a magazine by use of only human hands.

Hand loading cartridges may also damage the cartridge, especially the smaller caliber weapons like 0.22 caliber, thus increasing the frequency of jamming in automatic weapons. This jamming results because as the magazine is being loaded, the user typically will use the base or the rim of the cartridge being loaded to depresses the previously loaded cartridge. Because the spring compresses with each succeeding cartridge loaded, it becomes more difficult to insert the next cartridge. Thus the rim of the cartridge being loaded often dents or deforms the casing of the cartridge upon which it is acting. Later when the firearm is fired, these casing deformations interfere with the smooth split-second feeding action to the bolt such that the cartridge jams in the breech of the firearm.

In a like manner, similar problems also exist when it becomes necessary to unload a magazine which still contains cartridges. Although magazines can be unloaded by hand without the use of any apparatus, unloading by hand is slow, tedious, and cumbersome so that it is useful to provide an apparatus for assisting in the unloading process. In cases where the cartridges are stacked it is particularly difficult to unload a magazine by use of only human hands.

Unless one is actually using a firearm it is generally not desirable to store or transport a magazine which is loaded with cartridges. First, in many jurisdictions the transportation of a loaded cartridge is unlawful. Secondly, storing a magazine which is loaded may reduce its ability to function reliably, especially in higher capacity (40+ rounds) magazines. When a magazine is fully loaded the spring is fully compressed. After an extended period of time the compression of the spring will cause metal fatigue and the spring begins to weakens or "relax." Then, the next time the magazine is used in a firearm, the spring force is insufficient as required for rapid feeding of cartridges into the firearm, where the cartridge has to pop up instantaneously for the next round to be chambered by the bolt. This jamming is especially evident on a 50-round magazine where the last few rounds often have a tendency to jam if the magazine was left loaded for an extended period of time.

The standard way to unload a magazine is to apply force, usually with the thumb, to the rear of the topmost exposed cartridge pushing it forward until it slips past the retaining lips and out the open end of the magazine. As the magazine is being unloaded it is necessary to overcome friction between the feed lips and the cartridge caused by the spring force. To unload high capacity stacked magazines, it may also be necessary to depress all previously loaded cartridges before the topmost cartridge can be unloaded axially forwardly. Again, most magazines can be unloaded by hand without the use of any apparatus. However, hand unloading is often time-consuming and cumbersome.

As a result many firearm operators, rather than unload their magazines, simply discharge the cartridges though the firearm, in effect wasting the cartridges. This is particularly true in the military where numerous personnel may have multiple 20-round magazines at the conclusion of a maneuver. Rather than tediously unloading each magazine, which cannot be transported while loaded, they simply fire off hundreds of rounds of ammunition in order to empty the magazines.

It can readily be seen that the task of loading successive rounds of ammunition into a magazine is one which requires some care and manual dexterity. This is particularly true on cold days when a user's fingers are numb, or are enclosed in a glove, or in a situation (such as military combat) when speed in reloading may be of the essence. It is readily apparent that any simplification of the loading and unloading operation would make it quicker and easier to perform.

A number of devices exists which are adapted to assist the user in accomplishing this task. Each of these devices were designed to provide a more satisfactory form of loading ammunition into a magazine but do not realistically solve the problems encountered in loading and unloading round of ammunition into a magazine.

U.S. Pat. No. 4,464,855, issued to Musgrave on Aug. 14, 1984, teaches a slidably attached apparatus which is adapted with a pulling handle and a protrusion which is adapted to push a round of ammunition down into the magazine for insertion of the next round. After each successive round of ammunition is loaded into the magazine, the apparatus must be removed from the magazine and reinserted for the next round to be loaded. While it does facilitate loading, the requirement of reinsertion, sliding, and removal makes its use somewhat tedious and awkward. Further, it is cumbersome to use as difficulties may be encountered in holding the device in place against the magazine. As it requires several cartridges to fill a magazine, and as the user has only two hands, he must manipulate cartridges, guide, and magazine, carefully and with much skill.

It should also be noted that all of the prior art devices, primarily because of their structure, are useful only in a narrow range of magazine sizes. Thus, a firearm owner with a variety of weapons would typically have to purchase a number of different devices to accommodate his collection. Further, all of these devices are strictly utilized to load a magazine and are not for the purpose of rapidly unloading an already loaded magazine.

The prior art does not include a device which accommodates a variety of cartridge shapes and a variety of magazine sizes and types, which permits the loading and unloading task to be repeatedly and continuously performed with one hand, which comprises no moving parts and which is without cumbersome dimensions.

Because a loading mechanism may be used in field or outdoor conditions, devices which depend upon springs or motors are subject to freezing from exposure to cold and/or corrosion or deterioration from exposure to water and the like. Thus, it is advantageous to provide a device which orients cartridges and can be used for loading cartridges but which does not require a motor or springs to orient or move the cartridges.

Accordingly it is an object of the present invention to provide an improved magazine loader which is substantially free of the disadvantages of prior loaders.

Another object is to provide a tool which is completely adapted for ambidextrous use.

Another object is to provide a tool which universally loads and unloads the various caliber cartridges and magazines utilized by automatic pistols and rifles.

Another object is to provide a high quality, durable tool, which is light weight such that it can be easily carried in a user's hunting vest, pocket, or firearm case.

Another object is to provide an improved magazine loader which can be employed to quickly and efficiently load and unload cartridges in a magazine.

Another object is to provide a loading and unloading tool which will not scratch, dent, or deform firearms, cartridges, or the accessories commonly used with those firearms.

Another object is to provide such a device which will be simple and economical to fabricate.

An additional object is to provide a tool which functions smoothly and efficiently to load and unload a stacked magazine having two rows of cartridges.

SUMMARY OF THE INVENTION

The present invention provides an improved device which can universally unload, easily and quickly, all firearm magazines currently manufactured, both foreign and domestic.

The present invention achieves the above objects and solves the problems presented by the prior art by utilizing an improved device to quickly and efficiently load cartridges in a magazine.

BRIEF DESCRIPTION OF THE DRAWINGS

These and other objects, specific advantages, and features of the present invention will become more apparent upon a reading of the following detailed description of specific examples and embodiments thereof, when read in conjunction with an examination of the accompanying drawings, wherein like reference numerals designate like parts throughout. The dimensions in the drawings are not to scale.

DETAILED DESCRIPTION OF THE INVENTION

Figure 1:
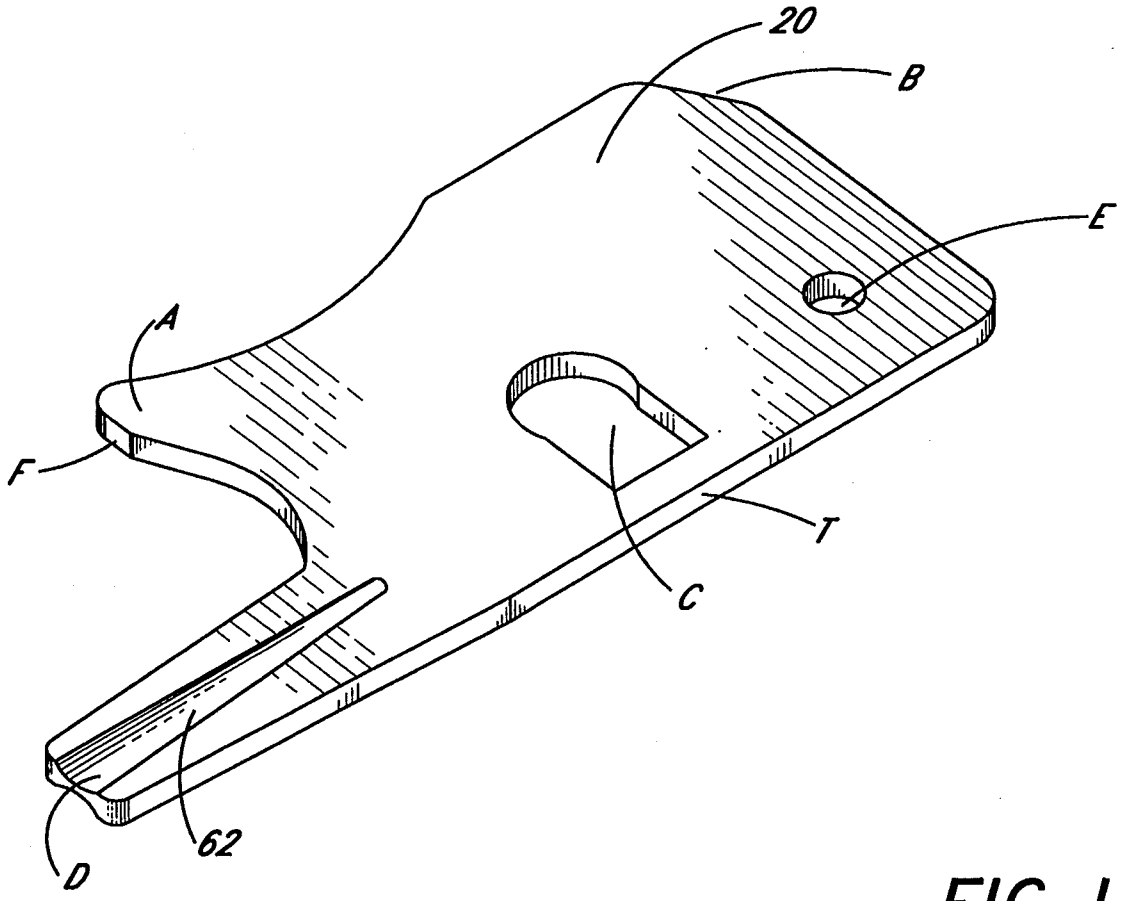
FIG. 1 is a perspective view of the magazine tool.
Figure 3:
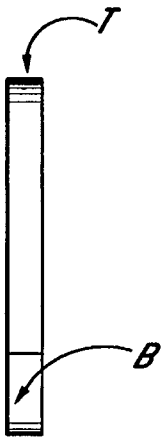
FIG. 3 is a right-side elevational view of the tool.
Figure 4:
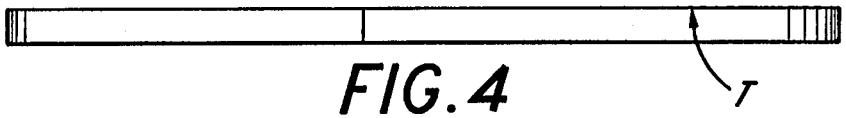
FIG. 4 is a top edge plan view of the tool.

Referring now to the drawings in general and to FIGS. 1–6 in particular, the general structure of the device will be described. FIG. 1 is a perspective view of the preferred embodiment of the magazine tool 20 which generally comprises an elongated rectangular structure approximately 3" long and about 1.5" wide and adapted to be attached to a key chain through an aperture E. The tool 20 can be constructed of a wide variety of materials, including metal or plastic. In the preferred embodiment, the tool base is constructed of a single piece of 30% glass-filled Grilon ® plastic, manufactured by EMS-American Grilon Inc., in Sumter, S.C.

Figure 2:
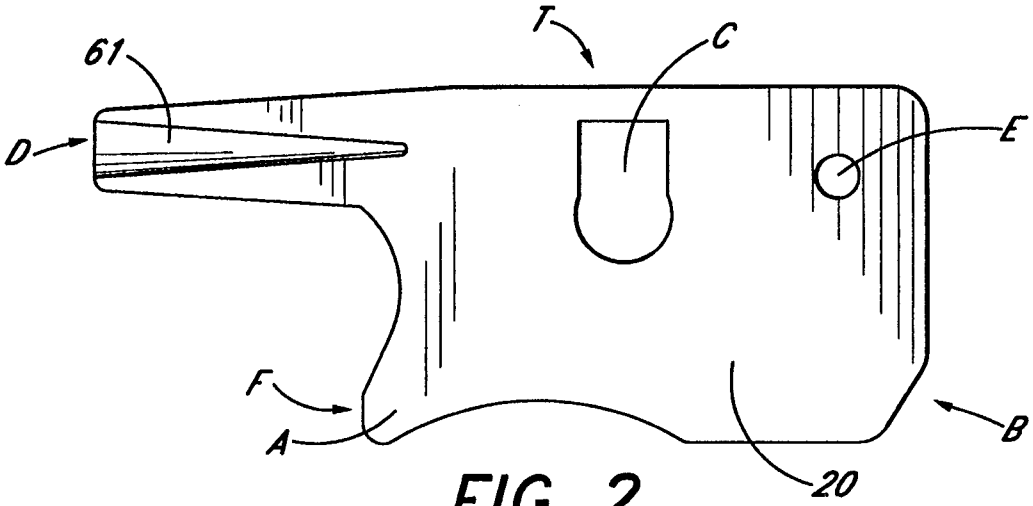
FIG. 2 is a front-side elevational view of the magazine tool, of which the back-side is a mirror image.
Figure 5:
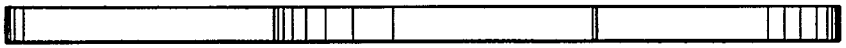
FIG. 5 is a bottom edge plan view of the tool.
Figure 6:
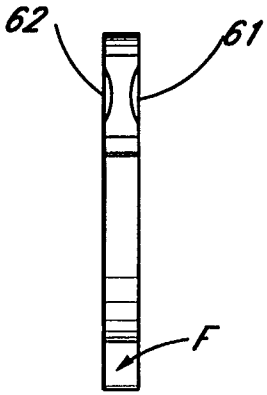
FIG. 6 is a left-side elevational view of the tool.

In FIG. 2 it will been that different portions of the tool 20 are specially adapted to perform specific loading and unloading functions. One extension from the tool base (edge A) is typically utilized to unload automatic pistol magazines as described below. The edge A is particularly adapted with a flat portion to better engage certain magazines in which the retaining lips are asymmetrical. The edge B of the tool is used to rapidly unload high capacity stacked magazines. An aperture C in the tool base is used to facilitate the rapid loading of cartridges into a magazine with a thumb button. Another extension of the tool base (extension D), also called the cartridge guide extension, is used to facilitate the rapid loading of cartridges into a wide variety of magazines. A pair of grooves 61, 62 (see FIGS. 2 and 6) are cut into the top and bottom side of the extension D to facilitate the placement of cartridges.

Figure 11:
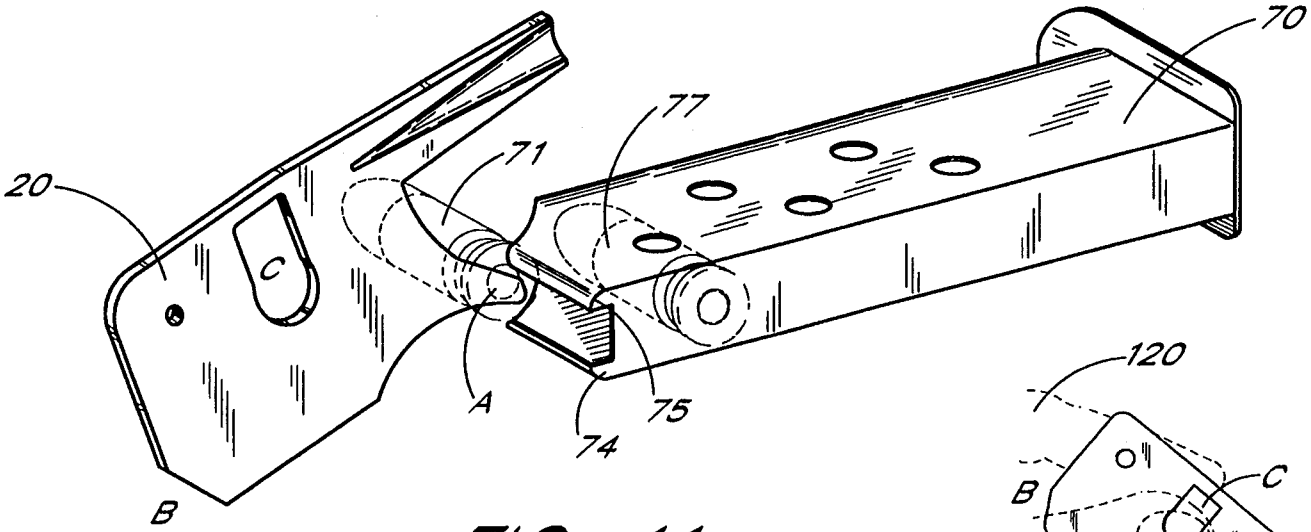
FIG. 11 is a perspective view of the magazine tool utilizing the edge A to unload cartridges from a magazine.

FIG. 11 is a perspective view of the magazine tool 20 utilizing the edge A to unload cartridges 71 from a conventional well-known magazine 70.

Figure 7:
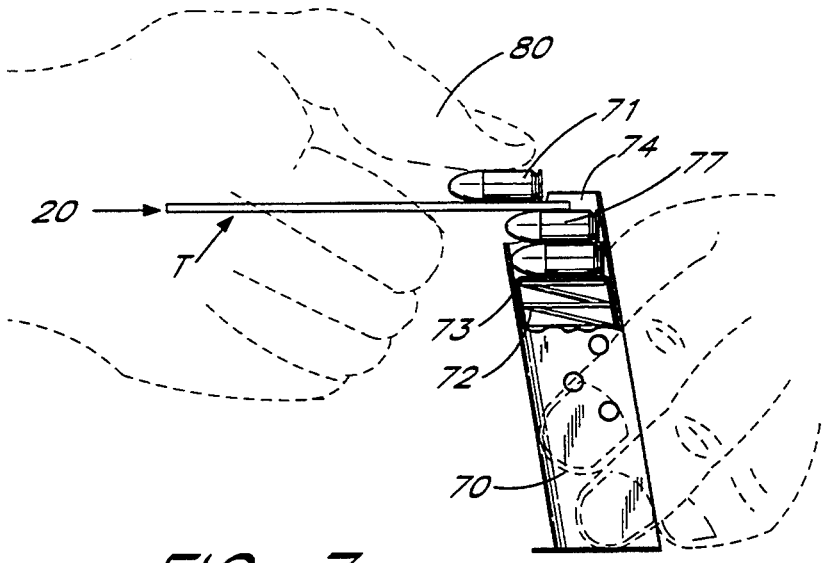
FIG. 7 is a side view of the magazine tool utilizing the extension D to load cartridges into a magazine.
Figure 8:
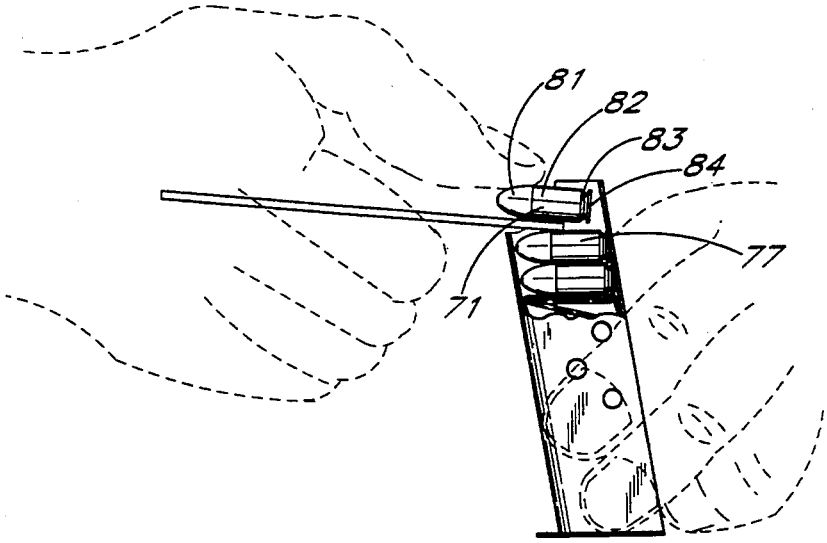
FIG. 8 is a side view of the magazine tool utilizing the extension D to load cartridges into a magazine.

The significant structural features of the known conventional magazine 70 are best understood by looking briefly at FIGS. 7 and 8. As shown therein, the magazine 70 is equipped with a magazine spring 72 which urges a magazine follower 73 upwardly. The magazine 70 terminates in a pair of feed lips for retaining a cartridge, specifically, a left lip 74 and a right lip 75. (Only the right lip 74 is shown in this cut-away. Both cartridge retaining lips 74,75 can be seen in FIG. 11). The cartridge retaining lips 74, 75 are juxtaposed with respect to each other and function to keep the cartridges 71 within the magazine 70. In order to perform this function, they are spaced from each other a distance less than the diameter of a single cartridge 71. In such a magazine 70 a cartridge follower 73, which is biased toward the open end of the magazine 70 by a magazine spring 72, is used to force the cartridge 71 toward the top of the magazine 70.

As shown in FIG. 8, a typical cartridge, such as the cartridge 71, comprises a projectile 81 held in a casing 82. The casing 82 is provided with an extractor recess 83 and a base or rim 84. Without the tool 20 of the present invention, a person would normally be required to use a finger or thumb to depress an uppermost cartridge 77 out of the way and hold such cartridge 77 in place while the next cartridge 71 is slipped into position. Not only does such a task require the full use of two hands, but it also requires substantial dexterity and strength of the hand responsible for pushing and holding a present uppermost cartridge 77 into position. This task is particularly arduous and causes considerable discomfort in the fingers. This task is especially difficult when the weather is cold or the person loading the ammunition is wearing gloves.

Each successive cartridge 71 is loaded into the magazine 70, and the process is repeated as many times as necessary to fill the magazine 70 to capacity. As each successive cartridge 71 is loaded into the magazine 70, the task becomes more and more difficult to operate as the compression on the spring 72 increases.

In order to load a cartridge 71 into the open end of the magazine 70, it is necessary to push an uppermost cartridge 77 down into the magazine 70 and to slide or insert another cartridge 71 in between the retaining lips 74,75 and a present uppermost cartridge 77. Assistance with this task is the purpose of the present invention.

LOADING WITH TOOL - GUIDE EXTENSION D

The edge D of the tool 20, called the cartridge guide extension, is used to facilitate the rapid loading of cartridges 71 into a wide variety of magazines. In operation, the tool 20 is employed to load a magazine 70 as follows. An empty magazine 70 is first loaded with a cartridge 77 in any convenient manner or in the manner described below.

As depicted in FIG. 7, a right-handed user grasps the magazine 70 in the left hand such that the first cartridge 77 is pointed to his right with its longitudinal axis substantially parallel to the ground. The tool 20 is gripped with the right hand such that the edge T fits in the joint at the base of the index finger and the hand. When the index finger is wrapped around the tool 20 it engages the tool 20 in the depression between the edges A and D.

The user's thumb 80 is placed on the top side of the tool 20 and the depression on the opposite edge engages the center of the middle joint on the index finger. The thumb is aligned along the edge T with the thumb tip being closest to the hole E. For left handed operation, the same description would apply.

Next a cartridge 71 is placed on the top side of the guide extension D such that the base or rim 84 of the cartridge 71 is approximately $\frac{3}{8}$ inch back from the tip of the guide. The cartridge 71 is held in this position by the grooves 61 on the top side of the extension guide D as well as the user's thumb 80 which is placed on the top of the cartridge 71 opposite of the groove 61.

Thereafter, the guide extension D contacts an uppermost cartridge 77 behind the forward edge of the cartridge-retaining lips 74, 75 using the groove 62 to assist in aligning the extension D with respect to the cartridge 77. It can been seen that in magazine 70 where the cartridges 71,77 are stacked in a single linear fashion, the groove 62 on the bottom side of the extension guide D will rest on the cartridge below it and as such the guide D will be self-centering. Pressure is applied with the bottom side of the guide extension D to the casing of the top-most cartridge 77 to cause the cartridge and/or follower 16 to move downwardly. At this point, the first cartridge 77 is moved away from the feedlips 74, 75. It is also moved downwardly against the upward force of the magazine spring 72. This opens a space between the feedlips 74, 75 and the first cartridge 77. The cartridge 77 is continually depressed downwardly a distance sufficient to create a space to insert another cartridge such as the cartridge 71.

Figure 9:
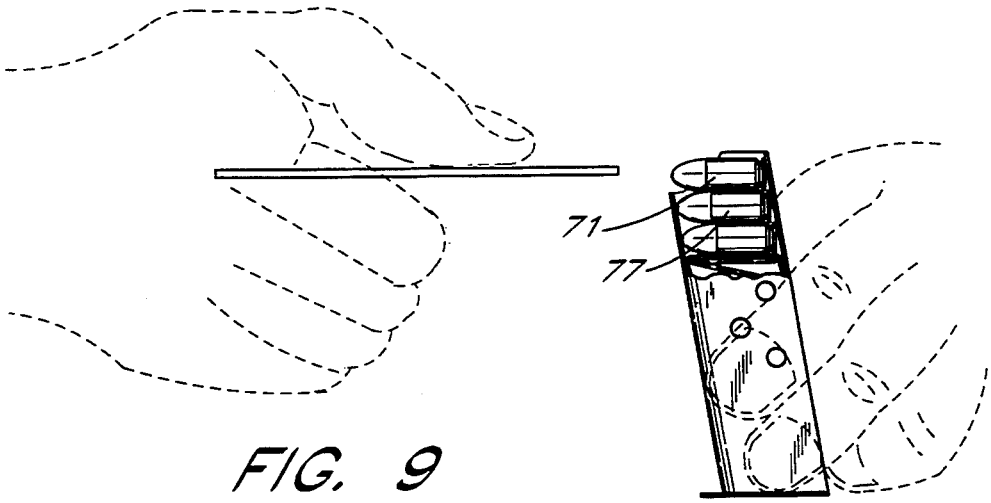
FIG. 9 is a side view of the magazine tool utilizing the extension D to load cartridges into a magazine.

In FIG. 8, the cartridge 71 is further manually inserted with the user's thumb 80 until the rim 84 of the cartridge 71 contacts the rear wall of the magazine 70. Next, the tool 20 is extracted, as shown in FIG. 9, thus permitting the top cartridge 71 to rise under the influence of the force exerted by the spring 72 thus permitting the cartridge 71 to engage the feed lips 74,75 as shown in FIG. 11. In order to fill the magazine 70 with cartridges to capacity, it is only necessary to continually repeat the above steps in the order recited.

Because the tool is preferably made of Grilon® there is no damage to the casing of the previously loaded cartridge. The Grilon® won't scratch or dent the cartridges 71,77 or magazine 70 and a user will not accidentally discharge a cartridge as the tool 20 is not metal.

An alternative method (not shown) of loading can be utilized on all variety of cartridges, but is particularly effective when used on cartridges which are small caliber, such as, for example, 0.25 and 0.32 caliber. As described above, the user places a cartridge 71 on the top side of the extension guide D such that the rim 84 of the cartridge 71 is approximately ⅜ inch back from the edge of guide D, with the cartridge 71 held in position by the user's thumb 80.

In this method, rather than applying pressure with the bottom of the tool 20 to the casing 82 of the top cartridge 77, pressure is applied only to the bullet portion 81 of the cartridge 77 to cause the front end of the cartridge 77 to rotate or tip downwardly. This downward rotation or tipping provides a space between the feedlips 74, 75 and the front of the first cartridge 77. This space is ideally adapted to receive a second cartridge 71. The cartridge 71 is further manually inserted with the user's thumb until the rim 84 of the cartridge 71 contacts the rear wall of the magazine 70. Next, the tool 20 is extracted, thus permitting the top cartridge 71 to rise under the influence of the force exerted by the spring 72 thus permitting the cartridge 71 to engage the feed lips 74, 75.

LOADING WITH TOOL - APERTURE C

Figure 10:
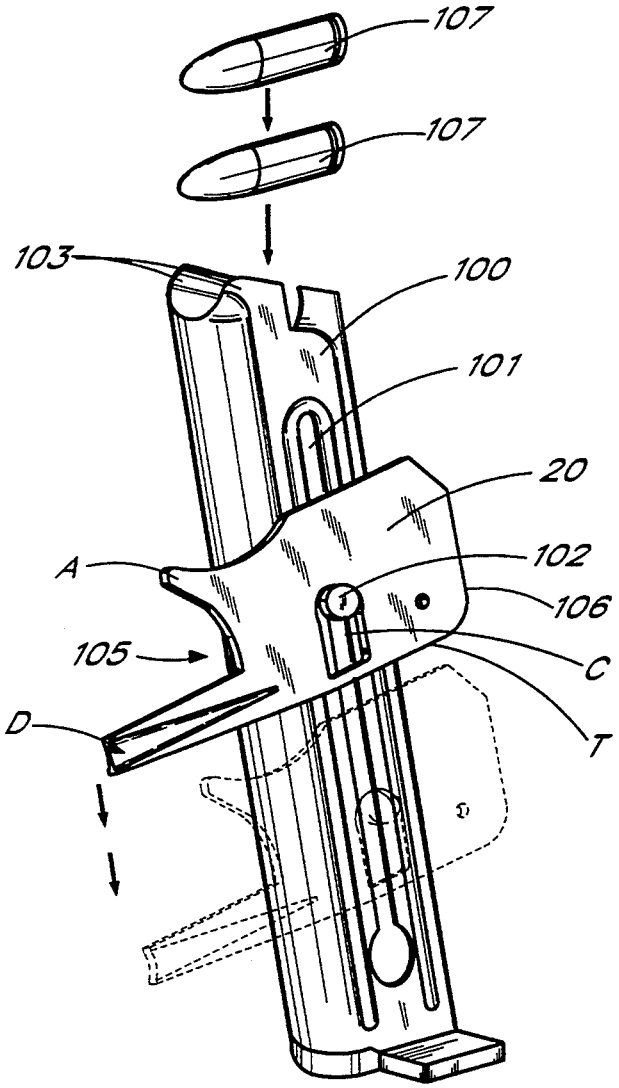
FIG. 10 is a perspective view of the magazine tool utilizing the aperture C to load cartridges into a 0.22 caliber button magazine.

FIG. 10 depicts a magazine 100 utilized by many 0.22 caliber weapons. The magazine 100 is a slightly different variation from the magazine 70 disclosed above. Typically, a magazine 100 has a slot 101 running most of the length of the magazine 100 and parallel with the longitudinal axis of the magazine 100. A button 102 which is attached to the follower in the magazine 100 (not shown) protrudes through the slot 101. When the magazine 100 is empty, the button 102 along with the follower is in a position toward the top of the magazine 100 near the feed lips 103. A user by sliding the button 102 toward the bottom of the magazine 100, away from the feed lips 103, displaces the follower and compresses the spring, thus opening a space between the top of the follower and the feed lips 103 into which a cartridge 107 can be inserted.

Although there are variations in the sizes and shapes of the thumb button 102, the tool 20 is adapted to fits all known current designs variations. Because of the small size of the button 102 and the spring force acting against it movement, displacement of the button 102 requires great pressure from a user's finger or thumb. The tool 20 helps to prevent the soreness and fatigue experienced when loading numerous cartridges 107 into these types of magazines.

The aperture C of the tool 20 is used to facilitate the rapid loading of cartridges 107 into this type of magazine 100. In the preferred embodiment, aperture C is key-hole shaped. Specifically, the aperture is elongated with an arc at one end and a pair of right angles at the other end. In operation, a user grasps the magazine 100 in one hand button-side up, such that when the fingers are wrapped around the magazine 100, the tip of the index finger is on the button 102 and pointing in a direction generally perpendicular to the longitudinal axis of the magazine 100. Next the index finger is unwrapped from the magazine 100 and the tool 20 is placed with its front side against the magazine 100 such that the magazine button 102 protrudes through the aperture C.

The tool 20 is properly oriented when the edge T is closest to the bottom of the magazine 100 and is aligned in a direction substantially perpendicular to the longitudinal axis of the magazine 100. Now, the magazine and tool are grasped from the front such that the thumb engages the tool 20 in the depression 105 between the edges A and D. The index finger engages tool edge 106, which is opposite of the depression 105, and is wrapped around the tool 20 and the back of the magazine 100.

When the user relaxes his grip on magazine 100, the magazine 100 is free to move upward in a direction parallel to slot 101 while the tool 20 and button 102 are held in a stationary position by the user's hand. By relaxing his grip, pushing the magazine 100 forward approximately an inch (depicted in phantom) and retightening his grip, the user has displaced the follower button 102 such that a few cartridges 107 can now be dropped into the space between the feed lips 103 of magazine 100 and the follower or an uppermost cartridge in the magazine 100 as the case may be.

As stated above the tool 20 is completely adapted for ambidextrous use. Here, a left-handed user could simply use his other hand and place the back side of the tool 20 against the magazine 100. This is another advantage of the tool 20 because this magazine 100 type is typically manufactured with a slot 101 on both sides and a button 102 relocatable as desired by right-handed or left-handed users.

UNLOADING WITH TOOL - EDGE A

Figure 13:
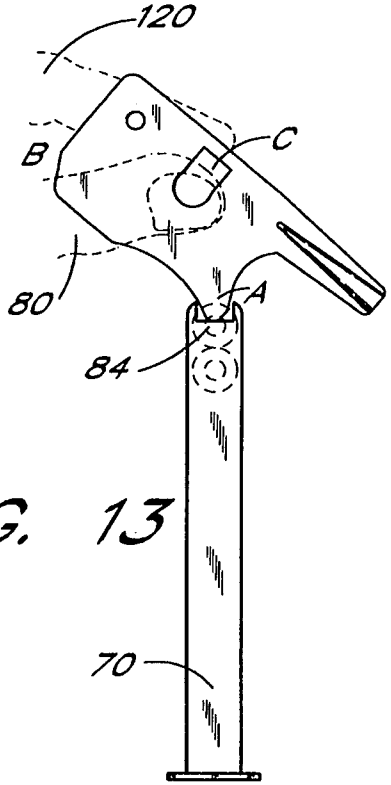
FIG. 13 is a back view of the magazine tool utilizing the edge A to unload cartridges from a magazine.
Figure 12:
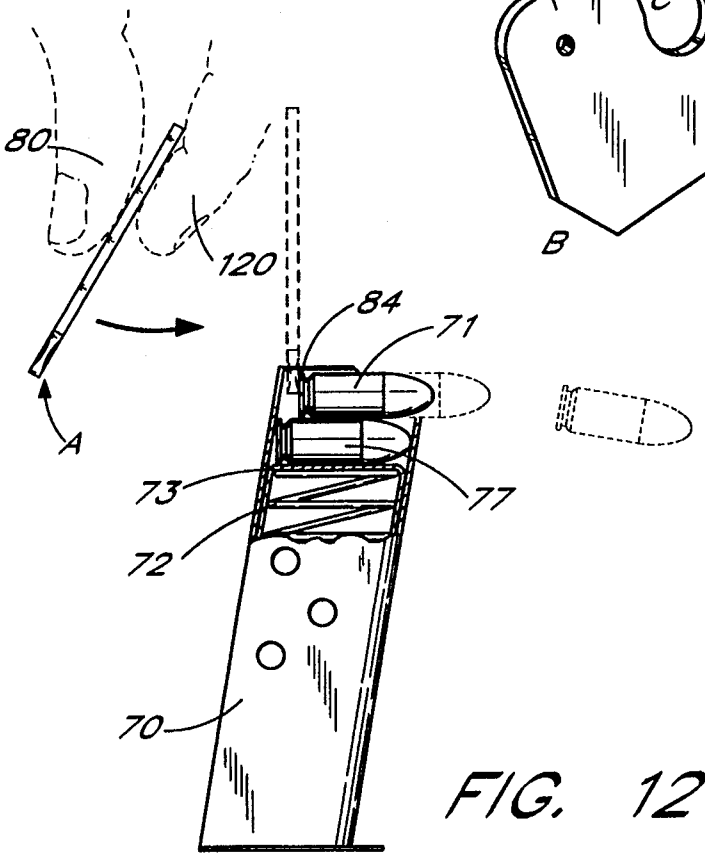
FIG. 12 is a side view of the magazine tool utilizing the edge A to unload cartridges from a magazine.

FIGS. 11–13 depict the extension edge A of the tool 20 which is used to facilitate the rapid unloading of cartridges 71 from a wide variety of magazines. A user grasps the magazine in one hand such that the first cartridge is pointed downward with its longitudinal axis substantially perpendicular to the ground. The tool 20 is gripped with the other hand such that the thumb 80 and the index finger 120 are on opposite sides of the center portion of the tool 20 with the thumb 80 being on the bottom of the tool 20. The thumb 80 is aligned with an axis which runs from the edge A to the hole E with the thumb tip being closest to the edge A. For left handed operation, the same description applies except that the thumb is placed on the top side of the tool 20.

The tool 20 is then brought into operating position by engaging the bottom side of the edge A against the exposed rear edge of the top cartridge 77 such that the edge A is flush against the cartridge 77. At this point the operator simply pushes the tool 20 causing the cartridge 77 to move in a direction substantially parallel to the its longitudinal axis until it clears the feed lips 74, 75 and falls to the ground. In order to completely unload the magazine 100 of its cartridges, it is only necessary to continually repeat the above steps in the order recited.

Figure 15:
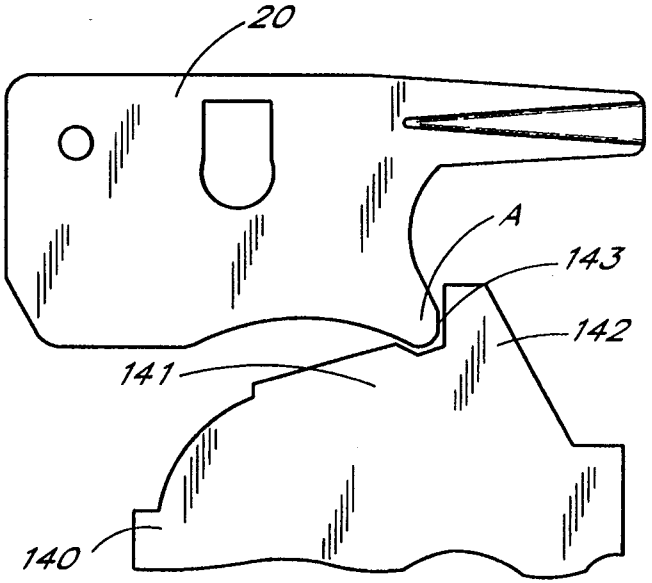
FIG. 15 is a back view of the magazine tool utilizing the edge A to unload cartridges from a Ruger 10/22 semi-automatic rifle magazine.
Figure 14:
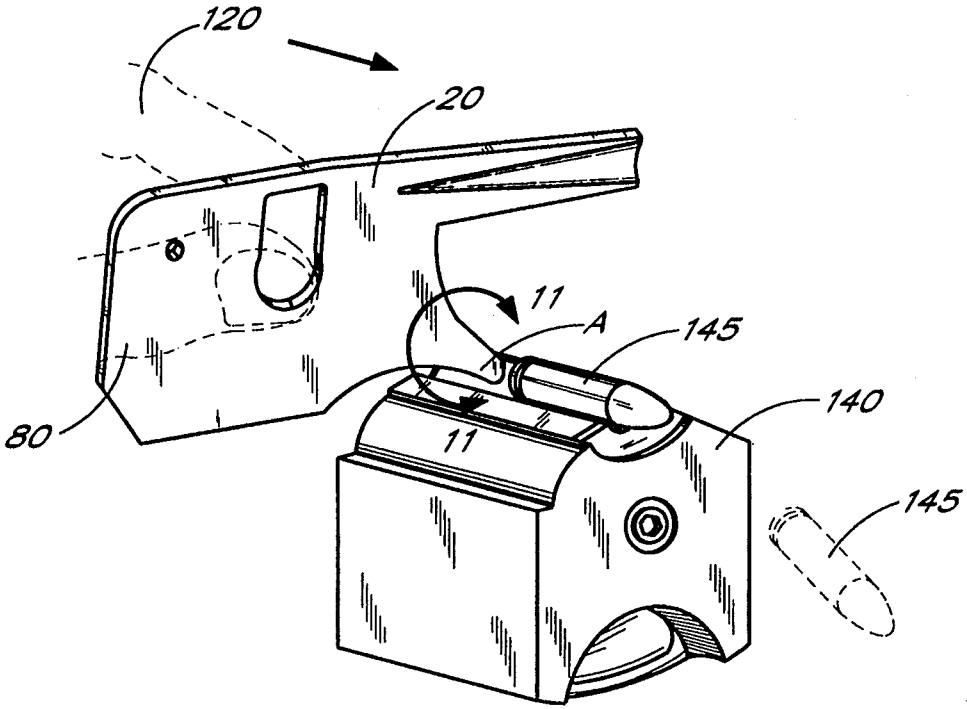
FIG. 14 is a perspective view of the magazine tool utilizing the edge A to unload cartridges from a Ruger 10/22 semi-automatic rifle magazine.

The edge A is particularly adapted with a flat portion, shown in FIGS. 14 and 15, to better engage a specific magazine 140, in which the feed lips 141, 142 are asymmetrical with one feed lip 142 extending further beyond the top of the magazine 100 such that it has a flat portion 143. The magazine 140 is typically used on the Ruger 10/22 semi-automatic rifle. FIGS. 14–15 depict the magazine 140 and the tool 20 which is used in the same manner as described above to unload cartridges 145.

It is readily apparent that the tool 20 or the magazine 70 can be held in numerous positions to accomplish the task of unloading a magazine 70. For example, the magazine 70 may be grasped such that the first cartridge 71 is pointed upward with its longitudinal axis substantially perpendicular to the ground. In this configuration, the front side of the edge A would be engaged against the exposed rear edge of rim 84 of top cartridge 71. As describe above, the user pushes the tool 20 to cause the cartridge 71 to move in a direction substantially parallel to its longitudinal axis until it clears feed lips 74,75 and falls to the ground.

UNLOADING WITH TOOL - EDGE B

Figure 16:
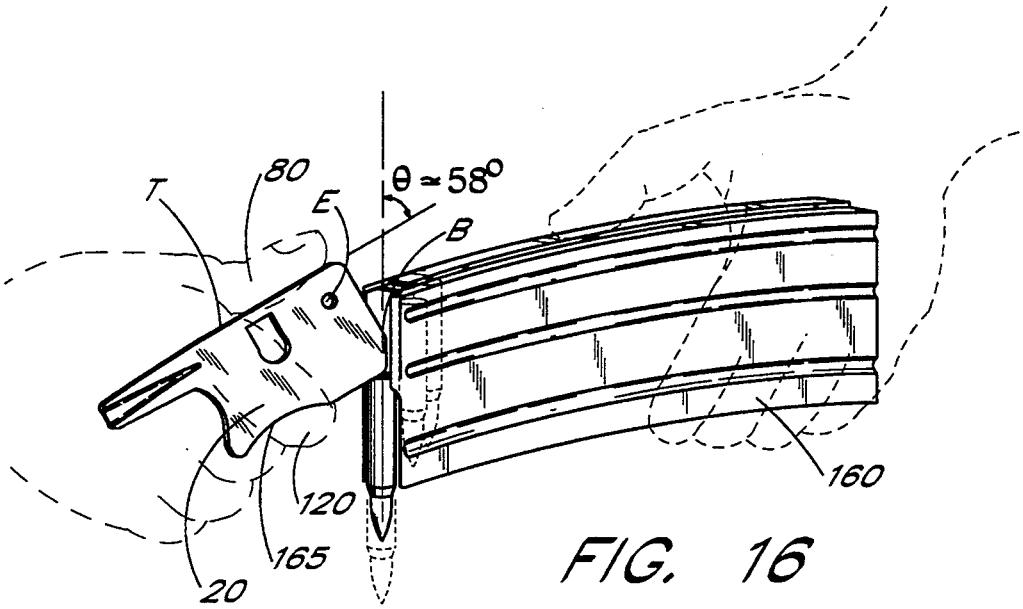
FIG. 16 is a perspective view of the magazine tool utilizing the edge B to unload cartridges from a stacked magazine.
Figure 17:
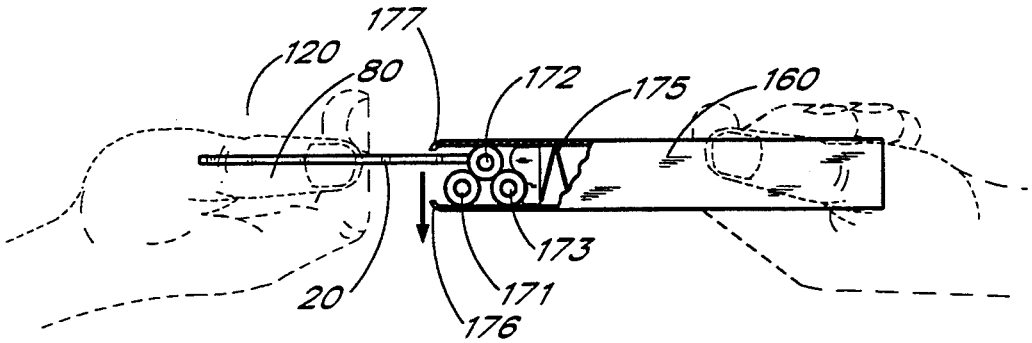
FIG. 17 is a side view of the magazine tool utilizing the edge B to unload cartridges from a stacked magazine.
Figure 18:
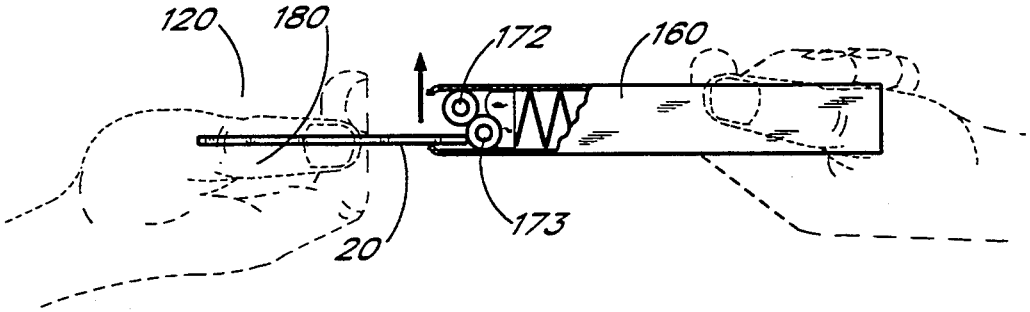
FIG. 18 is a side view of the magazine tool utilizing the edge B to unload cartridges from a stacked magazine.

FIGS. 16–18 depict the edge B of the tool 20 as used to rapidly unload a high capacity stacked magazine 160. In order to a achieve a higher capacity, many firearms utilize a "stacked" magazine 160 in which the cartridges 171,172,173 are held in two staggered rows, and the cartridges advance to the feed position under pressure from a spring 175, as a group. Feeding takes place alternately from the left feed lip 176 and the right feed lip 177 of the magazine 160. The space between the lips 176, 177 is greater than the maximum diameter of cartridge 171 thus allowing convenient refilling of magazine 160. When magazine 160 is in its normal position spring 175 is pushing against a stack of cartridges 171, 172, 173 such that the top cartridge 171 is retained by spring force against the left magazine feed lip 176.

In operation a user grasps the magazine 160 in one hand such that the first cartridge 171 is pointed downward with its longitudinal axis substantially perpendicular to the ground. The tool 20 is gripped with the other hand such that the thumb 80 is placed on the edge T and depression 165 on the opposite edge engages the center of the middle joint of the index finger 120. The thumb 80 is aligned along the edge T with the thumb tip being closest to the hole E. The key chain may be folded back along edge T and the user's thumb placed over it to retain the chain away from the magazine. For left handed operation, the same description applies with both the magazine 160 and the tool 20 positioned in a mirrored image of that shown.

The tool 20 is then brought into operating position by engaging the flat edge B against the center of the second cartridge 172 such that flat edge B is flush against the cartridge 172. At this point, side T of the tool 20 is at approximately a 58° angle to the cartridge 172. Although other angles may be used, this angle is preferable as providing the most efficient and comfortable position for the user. The tool 20 is pushed against a second cartridge 172 thus depressing the spring 175 and relieving the force previously holding a first cartridge 171 against the feed lip 176 of the magazine 160. With no force acting to hold a first cartridge 171 in the magazine 160, gravity acts on the cartridge 171 to cause it to fall from the magazine 160. At this point the user simply slides the tool 20 towards the center of a third cartridge 173, thus allowing a second cartridge 172 to slip past the tool 20 as the spring 175 forces the cartridge 173 toward the feed lips 176, 177. Now, the user keeps the spring 175 depressed and the second cartridge 172 falls out. Basically, the user simply rocks or wiggles the tool 20 with a steady motion back and forth quickly with very little movement of the wrist, yet always keeping the spring 175 depressed. The user continues this action sequentially depressing the second most cartridge thereby unloading the first cartridge until the magazine 160 is unloaded. In this manner a user can unload a 30-round magazine 100 in a few seconds.

The present invention may be embodied in other specific forms or utilized in a different manner to accomplish the equivalent task without departing from its spirit or essential characteristics. The above description and embodiments are to be considered in all respects only as illustrative and not restrictive. This invention may be further developed within the scope of the following claims. Accordingly, the above specification is to be interpreted as illustrative of only one operative embodiment of this invention, rather than in a strictly limited sense.

What is claimed is:

1. A tool comprising:

a planar tool base configured to be grasped by a user; and an extension protruding from said tool base for loading a cartridge into a first firearm magazine with retaining lips for retaining a top-most cartridge within said first magazine, said extension having a width less than the distance between the retaining lips of the first magazine and a first surface for depressing a first cartridge in said first magazine away from the retaining lips of the magazine to create a space between the first cartridge and the retaining lips, said extension having a second surface having a groove for retaining a second cartridge between said second surface and the user's thumb and guiding said second cartridge into said space.

2. A tool as set forth in claim 1, wherein the user holds said first magazine in one hand while using the tool with the other hand to load cartridges into said space.

3. A tool as set forth in claim 1, wherein the cartridges are loaded into said space by the movement of the user's thumb.

4. The tool as defined in claim 1, wherein said tool base and said extension are formed from a single mass of semi-rigid material.

5. A tool as defined in claim 1, further comprising a second extension having a surface for engaging the base of a top cartridge exposed beyond the retaining lips of said first magazine, said tool base allowing a user to push the extension to displace the cartridge in a direction substantially parallel to its longitudinal axis until the cartridge clears the retaining lips of said first magazine thereby removing said cartridge from said first magazine.

6. A tool comprising:

a planar tool base formed in a single plane configured for grasping by a user; and an extension in the same plane as said tool base for unloading a cartridge having a longitudinal axis from a first firearm magazine having retaining lips for retaining a top-most cartridge within a first magazine, said extension having two concave edges and an arc-shaped distal end sized for engaging the base of a top cartridge exposed beyond the retaining lips of said first magazine to displace the cartridge in a direction substantially parallel to its longitudinal axis until the cartridge clears the retaining lips of said first magazine.

7. The tool as defined in claim 6, wherein said extension further comprises a flat edge portion at the distal end to enable the extension to engage into an aperture of a magazine in which the retaining lips are asymmetrical.

8. A tool as defined in claim 6, wherein a second magazine utilizes a spring to force said top-most cartridge against the retaining lips, said tool further comprising a second flat edge for displacing a second cartridge beneath said top-most cartridge in a direction away from the retaining lips of said second magazine to create a space between said top-most cartridge and a second cartridge, said space thus created relieving the spring force previously holding said top-most cartridge against the retaining lips of said second magazine, such that said top-most cartridge falls from said second magazine when the top-most cartridge is pointed downward in a direction substantially perpendicular to the ground.

9. A tool for loading a cartridge having a longitudinal axis into a first firearm magazine having retaining lips for retaining a top-most cartridge within the first magazine and for loading a cartridge into a second firearm magazine with a follower button, the tool comprising:

a tool base configured to be grasped by a user, the tool base having an aperture to engage the follower button on the second magazine to slide the button to displace the follower away from the retaining lips of the second magazine to create a space between the follower and the retaining lips, and allowing a user to grasp the tool and the second magazine in one hand while using the other hand to load cartridges into the space; and an extension of the tool base having a first surface for depressing a first cartridge in the first magazine away from the retaining lips of the magazine to create a space between the first cartridge and the retaining lips, the extension having a second surface having a groove for retaining and guiding a second cartridge into the space.

10. A tool as defined in claim 9, further comprising a second extension having a surface for engaging the base of the top-most cartridge exposed beyond the retaining lips of the first magazine, the tool base allowing a user to push the extension to displace the top-most cartridge in a direction substantially parallel to its longitudinal axis until the top-most cartridge clears the retaining lips of the magazine thereby removing the top-most cartridge from the first magazine.

11. A tool as defined in claim 10, wherein a third magazine utilizes a spring to force the top-most cartridge against the retaining lips, the tool base also comprising a flat edge for displacing a second cartridge beneath the top-most cartridge in a direction away from the retaining lips of the third magazine to create a space between the top-most cartridge and a second cartridge, the space thus created relieving the spring force previously holding the top-most cartridge against the retaining lips of the third magazine such that the top-most cartridge falls from the third magazine when the top-most cartridge is pointed downward in a direction substantially perpendicular to the ground.

12. A tool as defined in claim 9, wherein a third magazine utilizes a spring to force the top-most cartridge against the retaining lips, the tool base also comprising a flat edge for displacing a second cartridge beneath the top-most cartridge in a direction away from the retaining lips of the first magazine to create a space between the top-most cartridge and a second cartridge, the space thus created relieving the spring force previously holding the top-most cartridge against the retaining lips of the first magazine such that the top-most cartridge falls from the first magazine when the top-most cartridge is pointed downward in a direction substantially perpendicular to the ground.

13. A tool for loading a cartridge into a first firearm magazine having retaining lips for retaining a top-most cartridge within the first magazine and for unloading a second magazine utilizing a spring to force a top-most cartridge against the retaining lips, the tool comprising:

a tool base configured to be grasped by a user;

a first extension of the tool base having a first surface for depressing a first cartridge in the first magazine away from the retaining lips of the magazine to create a space between the first cartridge and the retaining lips, the first extension having a second surface having a groove for retaining and guiding a second cartridge into the space;

a second extension of the tool base having a surface for engaging the base of a top cartridge exposed beyond the retaining lips of the first magazine, the tool base allowing a user to push the second extension to displace the cartridge in a direction substantially parallel to its longitudinal axis until the cartridge clears the retaining lips of the first magazine thereby removing the cartridge from the first magazine;

a flat edge for displacing a second cartridge beneath the top-most cartridge in a direction away from the retaining lips of the second magazine to create a space between the top-most cartridge and a second cartridge, the created space thus relieving the spring force previously holding the top-most cartridge against the retaining lips of the second magazine such that the top-most cartridge falls from the second magazine when the top-most cartridge is pointed downward in a direction substantially perpendicular to the ground.

14. A tool for loading a cartridge into a first firearm magazine having retaining lips for retaining a top-most cartridge within the first magazine and for unloading a second magazine utilizing a spring to force a top-most cartridge against the retaining lips, the tool comprising:

a tool base configured to be grasped by a user;

an extension of the tool base having a first surface for depressing a first cartridge in the first magazine away from the retaining lips of the magazine to create a space between the first cartridge and the retaining lips, the extension having a second surface having a groove for retaining and guiding a second cartridge into the space; and a flat edge for displacing a second cartridge beneath the top-most cartridge in a direction away from the retaining lips of the second magazine to create a gap between the top-most cartridge and a second cartridge, the gap thus created relieving the spring force previously holding the top-most cartridge against the retaining lips of the second magazine such that the top-most cartridge falls from the second magazine when the top-most cartridge is pointed downward in a direction substantially perpendicular to the ground.

* * * * *